US007448429B2

(12) United States Patent
Hirata et al.

(10) Patent No.: US 7,448,429 B2
(45) Date of Patent: Nov. 11, 2008

(54) METHOD FOR SQUEEZING FOUNDRY SAND, A MATCH PLATE, AND AN UPPER AND A LOWER FLASK

(75) Inventors: Minoru Hirata, Toyokawa (JP); Tokiya Terabe, Toyokawa (JP); Koichi Sakaguchi, Toyokawa (JP)

(73) Assignee: Sintokogio Ltd., Aichi-Ken (JP)

( * ) Notice: Subject to any disclaimer, the term of this patent is extended or adjusted under 35 U.S.C. 154(b) by 64 days.

(21) Appl. No.: 11/587,633

(22) PCT Filed: Apr. 27, 2005

(86) PCT No.: PCT/JP2005/007969

§ 371 (c)(1),
(2), (4) Date: Oct. 26, 2006

(87) PCT Pub. No.: WO2005/105339

PCT Pub. Date: Nov. 10, 2005

(65) Prior Publication Data

US 2007/0227684 A1 Oct. 4, 2007

(30) Foreign Application Priority Data

Apr. 28, 2004 (JP) ..... 2004-133547
Apr. 18, 2005 (JP) ..... 2005-119147

(51) Int. Cl.
*B22C 7/00* (2006.01)
*B22C 15/00* (2006.01)
*B22C 21/00* (2006.01)

(52) U.S. Cl. ..... 164/177; 164/187; 164/237; 164/378

(58) Field of Classification Search ..... 164/177, 164/187, 188, 200–202, 237–243, 374, 378, 164/384, 388–390
See application file for complete search history.

(56) References Cited

U.S. PATENT DOCUMENTS

| | | | | | |
|---|---|---|---|---|---|
| 365,711 | A | * | 6/1887 | Tabor | 164/187 |
| 485,764 | A | * | 11/1892 | Keenan | 164/378 |
| 3,406,738 | A | * | 10/1968 | Hunter | 164/182 |
| 4,030,535 | A | * | 6/1977 | Saka | 164/207 |
| 5,409,052 | A | | 4/1995 | Kaneto et al. | |

FOREIGN PATENT DOCUMENTS

| | | | | |
|---|---|---|---|---|
| DE | 43 40 401 | A1 | | 6/1994 |
| EP | 468355 | A2 | * | 1/1992 |
| EP | 0 493 977 | | | 7/1992 |
| JP | 57142745 | A | * | 9/1982 |
| JP | 59 24552 | | | 2/1984 |
| JP | 60158949 | A | * | 8/1985 |
| JP | 6 277800 | | | 10/1994 |
| JP | 08-187544 | A | | 7/1996 |
| JP | 2000 317579 | | | 11/2000 |
| JP | 2002 361368 | A | | 12/2002 |

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A method for squeezing foundry sand filled in an upper and a lower molding space, comprising: a step to squeeze the foundry sand by causing the upper and the lower squeeze plate to further approach each other, and a step to squeeze it by causing pattern portions of the match plate to move to each of the upper and the lower squeeze plate.

10 Claims, 9 Drawing Sheets

METHOD FOR SQUEEZING FOUNDRY SAND, A MATCH PLATE, AND AN UPPER AND A LOWER FLASK

TECHNICAL FIELD

This invention relates to a method for squeezing sand and producing a match plate. Particularly, it relates to a method for squeezing the foundry sand filled in an upper and a lower molding space defined by a match plate, an upper and a lower flask, and an upper and a lower squeeze plate. Further, it relates to the match plate and the upper and the lower flask.

BACKGROUND OF THE INVENTION

The inventors of this invention have developed the following apparatus for molding a mold:

The apparatus is comprised of an upper and a lower molding space, an aeration mechanism to discharge foundry sand into the molding spaces, and a squeezing mechanism to squeeze the foundry sand, wherein the upper and the lower molding space are defined by an upper and a lower flask each having intakes disposed at their side walls for foundry sand, a match plate disposed between the upper and the lower flask, and the squeezing mechanism having squeeze plates, which can be inserted in openings of the upper and the lower flask having no match plate. After filling the upper and the lower molding space with the foundry sand through the intakes of the upper and the lower flask by the aeration mechanism, the squeezing mechanism squeezes the foundry sand in the upper and the lower molding space by causing the upper and the lower squeeze plates to further approach each other. (See patent documents 1 and 2.)

However, the hardness and the strength near the inner surface that corresponds to the match plate, of the upper and the lower mold that are made by using the apparatus explained above, are not high enough.

Patent document 1: Japanese Patent Laid-open Publication No. H06-277800

Patent document 2: Japanese Patent Laid-open Publication No. S59-024552

DISCLOSURE OF INVENTION

The problem to be solved by the present invention is that the hardness and strength near the inner surface that corresponds to the match plate, of an upper and a lower mold that are made by using the conventional apparatus that can perform the following process, are not high enough:

The process is comprised of:

a step to define an upper and a lower molding space by an upper and a lower squeeze means, an upper and a lower flask, and a match plate, a step to fill the molding spaces with foundry sand, and a step to squeeze the foundry sand of the molding spaces by causing the upper and the lower squeeze plate to further approach each other.

To solve the problem, the following method is applied in this invention.

Namely, this is a method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, and a second squeezing step to squeeze the foundry sand in the upper and the lower molding space by causing the pattern portions of the match plate to move to each of the upper and the lower squeeze plate.

Further, a second method is applied in this invention to solve the problem:

Namely, a method for squeezing foundry sand, comprising:

a filling step to fill an upper and a lower molding space defined by any of the match plates, an upper and a lower flask, and an upper and a lower squeeze plate with the foundry sand, the match plate being comprised of:

a pattern portion disposed at both sides of the match plate, wherein both sides contact end surfaces of the upper and the lower flask, and at least one actuator to cause the pattern and the plate of the pattern portion to move toward the upper and the lower squeeze plate, a first squeezing step to squeeze the foundry sand in the upper and lower molding space by causing the upper and the lower squeeze plate to further approach each other, and a second squeezing step to squeeze the foundry sand in the upper and the lower molding space by causing the pattern and/or the plate of the pattern portions of the match plate to move to each of the upper and the lower squeeze plate.

As explained above, this invention is composed of the following:

a process for squeezing the foundry sand filled in the upper and the lower molding space defined by a match plate, an upper and a lower flask, and an upper and a lower squeeze plate, wherein the process is further comprised of a step to squeeze the foundry sand of the upper and the lower molding space by causing the upper and the lower squeeze plate to further approach each other, and a step to squeeze the foundry sand of the upper and the lower molding space by causing the pattern portions of the match plate to move to each of the upper and the lower squeeze plate.

Thus, since it becomes possible to further squeeze the foundry sand near the inner surface that corresponds to the match plate, of the upper and the lower flask, by causing the pattern portions of the match plate to move to each of the upper and the lower squeeze plate, it is possible to produce an upper and a lower mold having desirable hardness and strength near the inner surface of the upper and the lower flask. Namely, this invention has practical and excellent effects.

BRIEF DESCRIPTIONS OF THE DRAWINGS

FIG. 4(*b*) shows a plain view indicating another embodiment of an arrangement of the compression coil springs 10, 10.

FIG. 4(*c*) shows a plain view indicating another embodiment of an arrangement of the compression coil springs 10, 10.

FIG. 5(*b*) shows a cross section of an elevational view indicating a state while squeezing foundry sand in an embodiment of this invention.

FIG. 7(*b*) shows a plain view indicating another embodiment of an arrangement of the compression coil springs 23, 23.

FIG. 7(*c*) shows a plain view indicating another embodiment of an arrangement of the compression coil springs 23, 23.

FIG. 8(*b*) shows a cross section of an elevational view indicating a state while squeezing foundry sand in an embodiment of this invention.

PREFERRED EMBODIMENTS OF THE INVENTION

Figure 2:
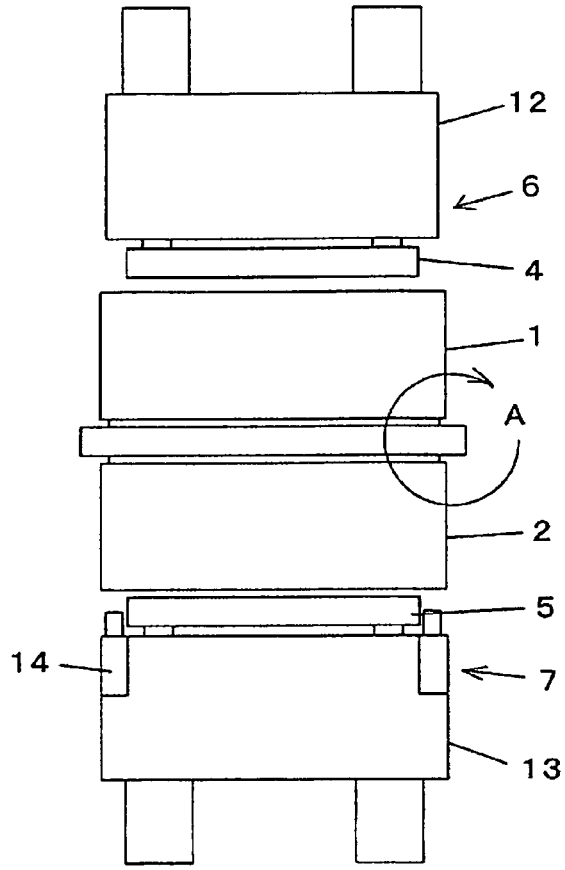
FIG. 2 shows an elevational view of a major portion of an apparatus for molding an upper and a lower mold having no flask which is used in this invention.

The present invention, which uses an apparatus for molding an upper and a lower mold having no flask, is now explained in detail based on FIG. 2.

The major portion of the apparatus for molding an:upper and a lower mold having no flask, which is used in this invention, is shown in FIG. 2. The apparatus is comprised of:

an upper and a lower flask 1, 2 each having intakes disposed at their side walls for foundry sand, a match plate 3 that is held between the upper and the lower flask 1, 2, and which have a special mechanism, an upper and a lower squeeze means 6, 7 having squeeze plates 4, 5, which can be inserted in openings of the upper and the lower flask 1, 2 having no match plate 3, an upper and a lower lifting and lowering frame 12, 13 provided with the upper and the lower squeeze means 6, 7, and cylinders 14, 14, which are mounted on the lower lifting and lowering frame 13, to press the lower flask 2 toward the match plate 3.

In this invention the apparatus for molding molds which uses the match plate can be used regardless of whether the molds have a flask.

Further, this invention can be applied to an apparatus for molding molds having not only one set of flasks, but also two sets of flasks.

The squeeze means of this invention is comprised of actuators and squeeze plates or squeeze feet. The squeeze means can individually squeeze the foundry sand. The actuators that are driven by hydraulic pressure, air pressure, and electric motors can be used as the actuators. It is preferable to use the actuators driven by the hydraulic pressure from the aspect of the magnitude of the output of the power. It is further preferable to use the actuators driven by the electric motors since they need no piping system for the hydraulic pressure.

In this invention, it is preferable to use green sand as foundry sand, which green sand uses bentonite as a binder.

Embodiment 1

Below, an embodiment for a method for squeezing foundry sand and a match plate of this invention is explained in detail based on FIGS. 1-4.

Figure 3:
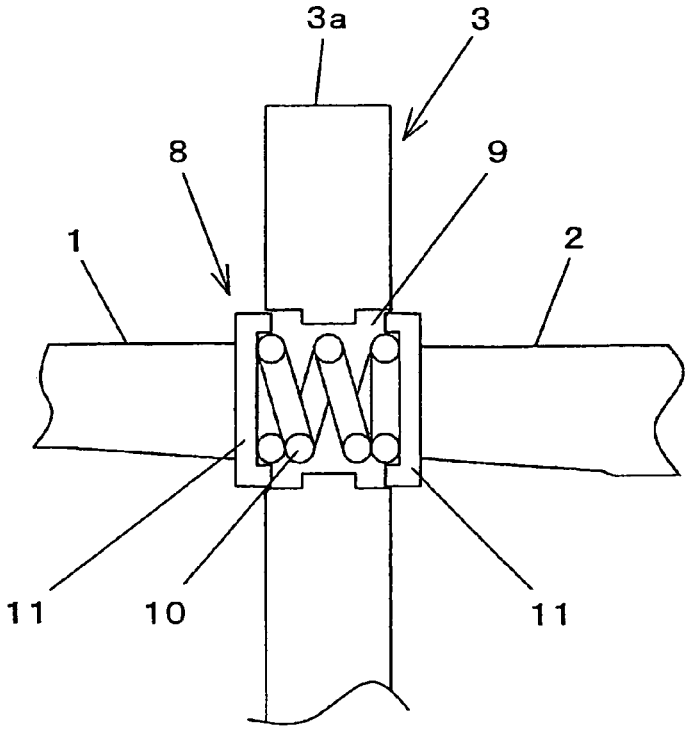
FIG. 3 shows an enlarged view of a part "A" of FIG. 2.
Figure 4:
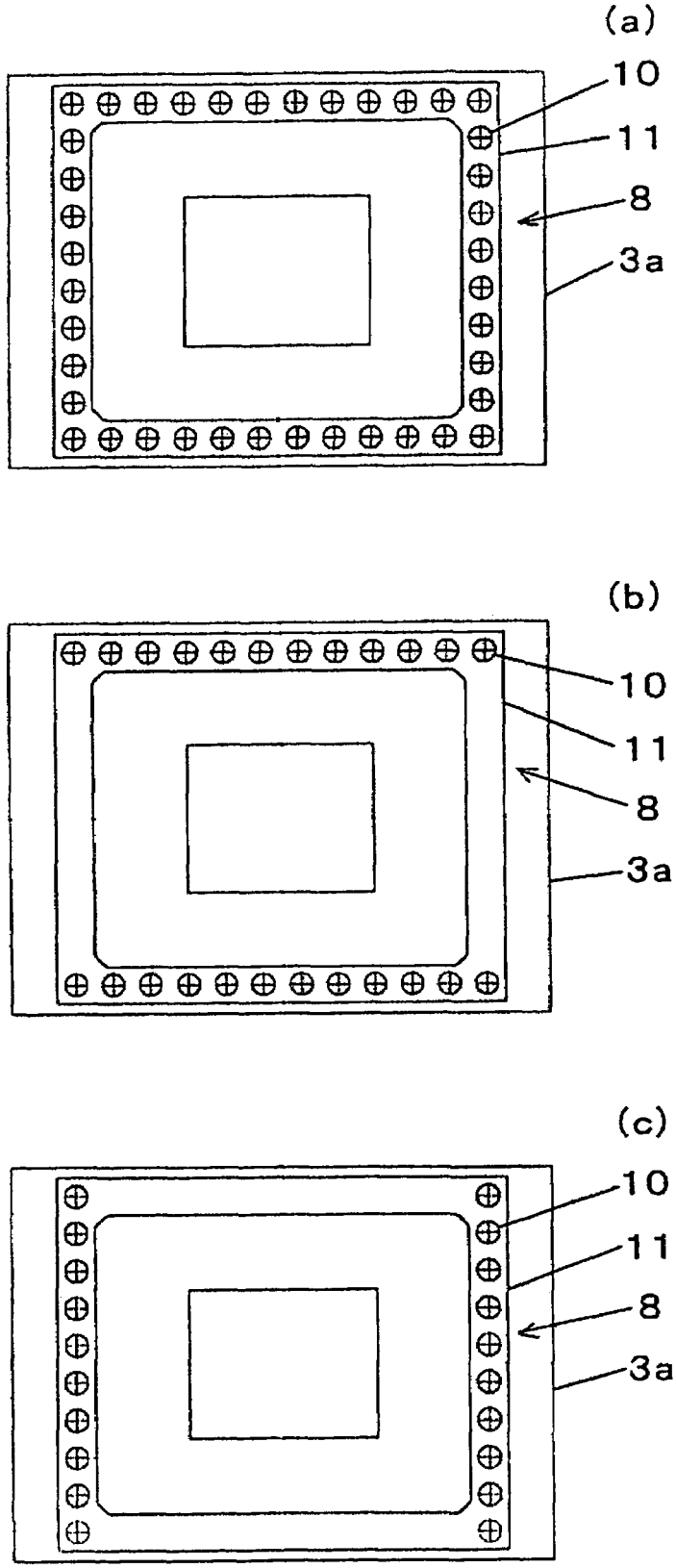
FIG. 4(*a*) shows a plain view indicating an embodiment of an arrangement of compression coil springs 10, 10.

An expanding and contracting means 8 is disposed at the peripheral border of the pattern portion of the body 3*a* of the match plate as shown in FIGS. 2-4, wherein the expanding and contracting means 8 can be expanded and contracted by being pressed with end surfaces of an upper and a lower flask 1, 2, which surfaces oppose the match plate 3. As shown in FIG. 3, the expanding and contracting means 8 is comprised of a plurality of compression coil-springs 10, 10 disposed in a plurality of through-holes 9, 9 formed at the body 3*a* of the match plate, and support members 11, 11 having a frame-like structure to hold the plurality of the compression coil-springs 10, 10 by compressing them at both sides of the coil-springs 10, 10, wherein the support members 11, 11 are mounted on the body 3*a* of the match plate.

As shown in FIG. 4, it is possible to dispose a plurality of the compression coil-springs 10, 10 of the expanding and contracting means 8 with the following arrangements: arranging them at the entire circumference of the peripheral border of the pattern portion at even intervals as shown in FIG. 4(*a*), arranging them at two longitudinal sides of the peripheral border of the pattern portion at even intervals as shown in FIG. 4(*b*), or arranging them at two lateral sides of the peripheral border of the pattern portion at even intervals as shown in FIG. 4(*c*). In all arrangements of the compression coil-springs explained above based on FIGS. 4(*a*), (*b*), and (*c*), the total force of the coil-springs should be more than the force that can support the weight of the upper and the lower flask 1, 2.

Below, the method for molding molds by using the apparatus of embodiment 1 is explained in detail.

Figure 1:
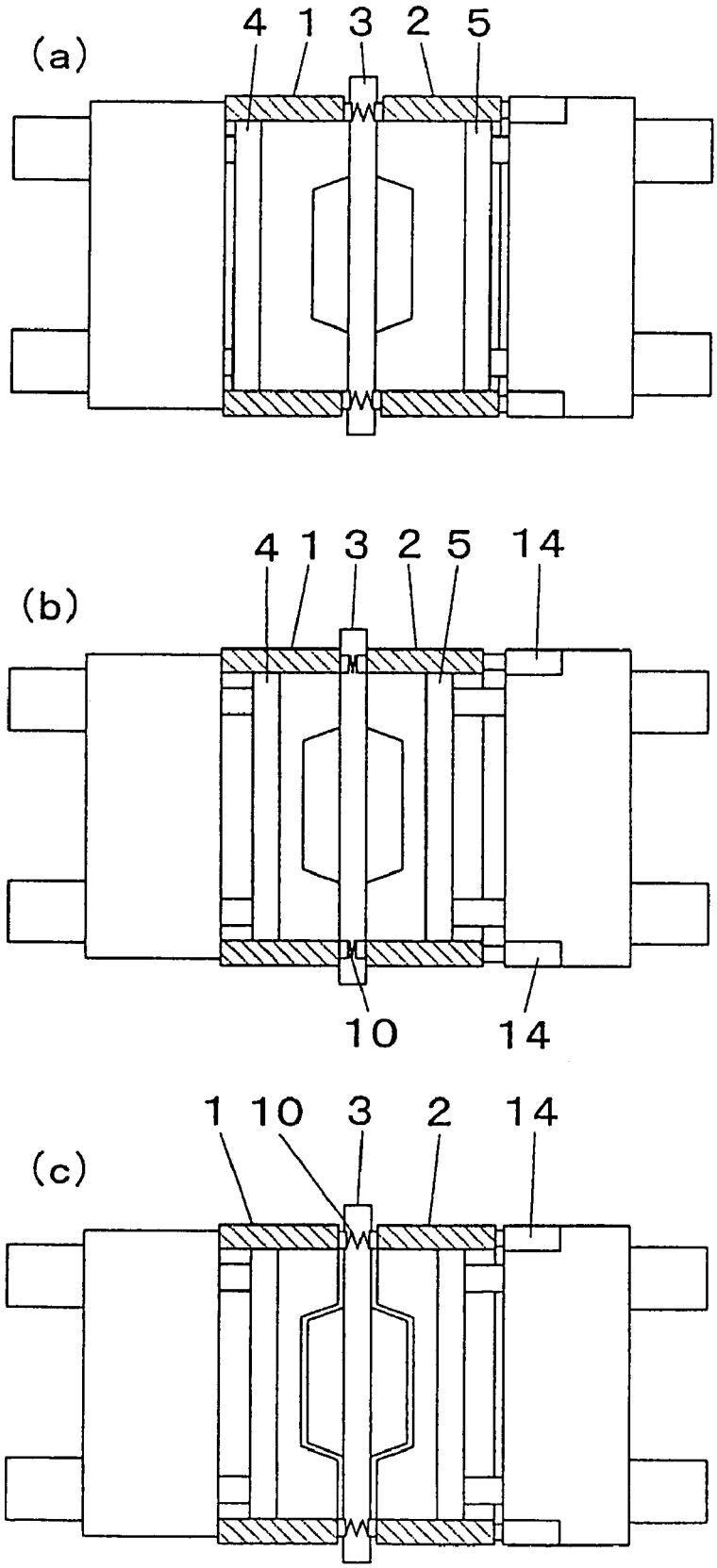
FIG. 1 shows a diagram to explain the processes of the preferred embodiments of this invention.

The foundry sand is filled in the upper and the lower molding space defined by a match plate 3, an upper and a lower flask 1, 2, and an upper and a lower squeeze plate 4, 5 as shown in FIG. 1(*a*). Then, the foundry sand in the upper and the lower molding space is squeezed by causing the upper and the lower squeeze plate 4, 5 to further approach each other as shown in FIG.

1(*b*). Next, the compression coil-springs 10, 10 of the expanding and contracting means 8 of the match plate 3 are compressed by pressing the lower flask 2 toward the match plate 3 by causing the cylinders 14, 14 to expand. When the compression coil-springs 10, 10 are compressed, each of the pattern portions of the match plate 3 moves relatively toward the upper and the lower squeeze plate 4, 5. Consequently, the foundry sand in the upper and the lower molding space is further squeezed. At that time, the upper and the lower lifting and lowering frame 12, 13 are fixed by tie-rods (not shown). Then, when the cylinders 14, 14 are contracted, the upper and the lower flask 1, 2 are separated by the reaction force of the compression coil-springs 10, 10 of the expanding and contracting means 8. Consequently, the molded molds made by squeezing the foundry sand are separated from the match plate 3.

Embodiment 2

Figure 5:
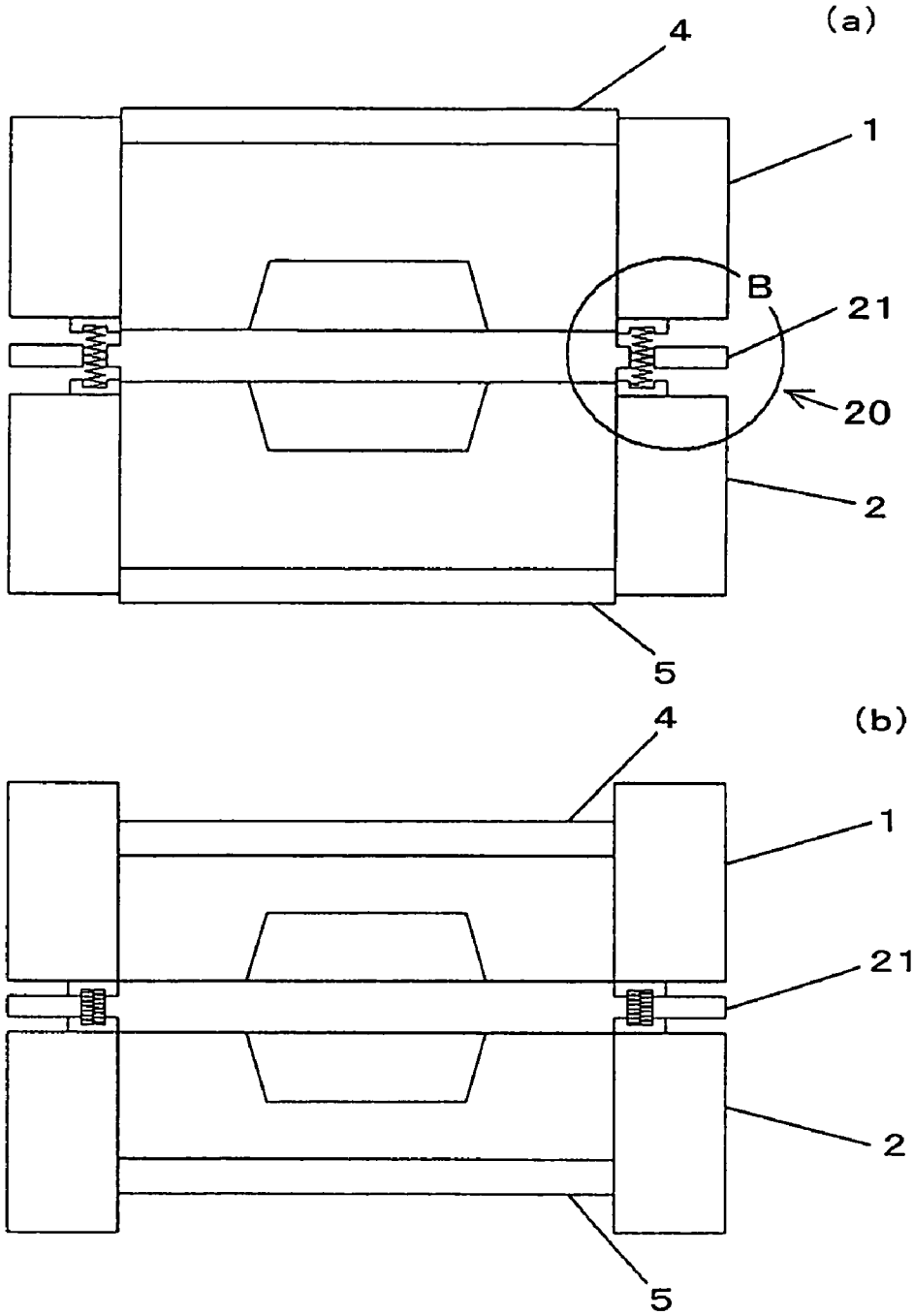
FIG. 5(*a*) shows a cross section of an elevational view indicating a state before squeezing foundry sand in an embodiment of this invention.
Figure 6:
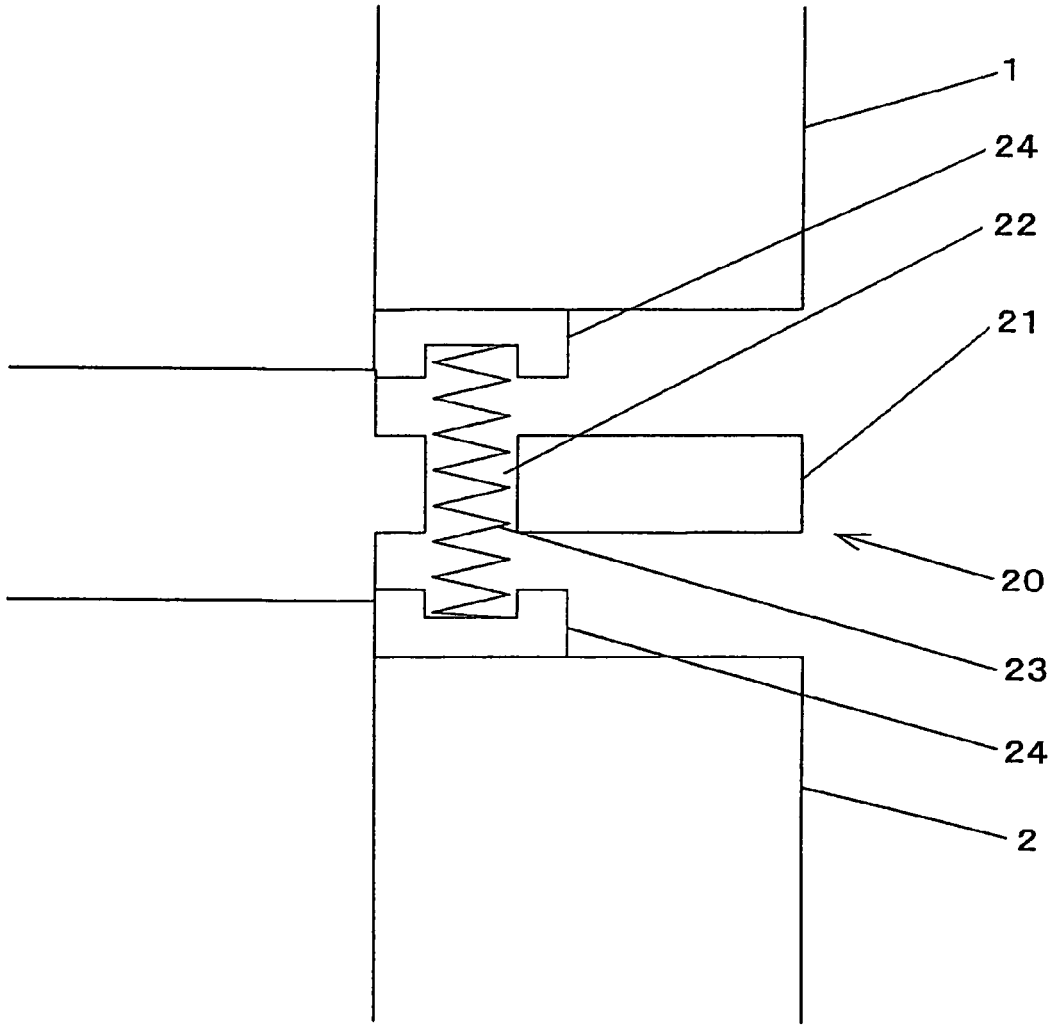
FIG. 6 shows an enlarged view of a part "B" of FIG. 5(*a*).
Figure 7:
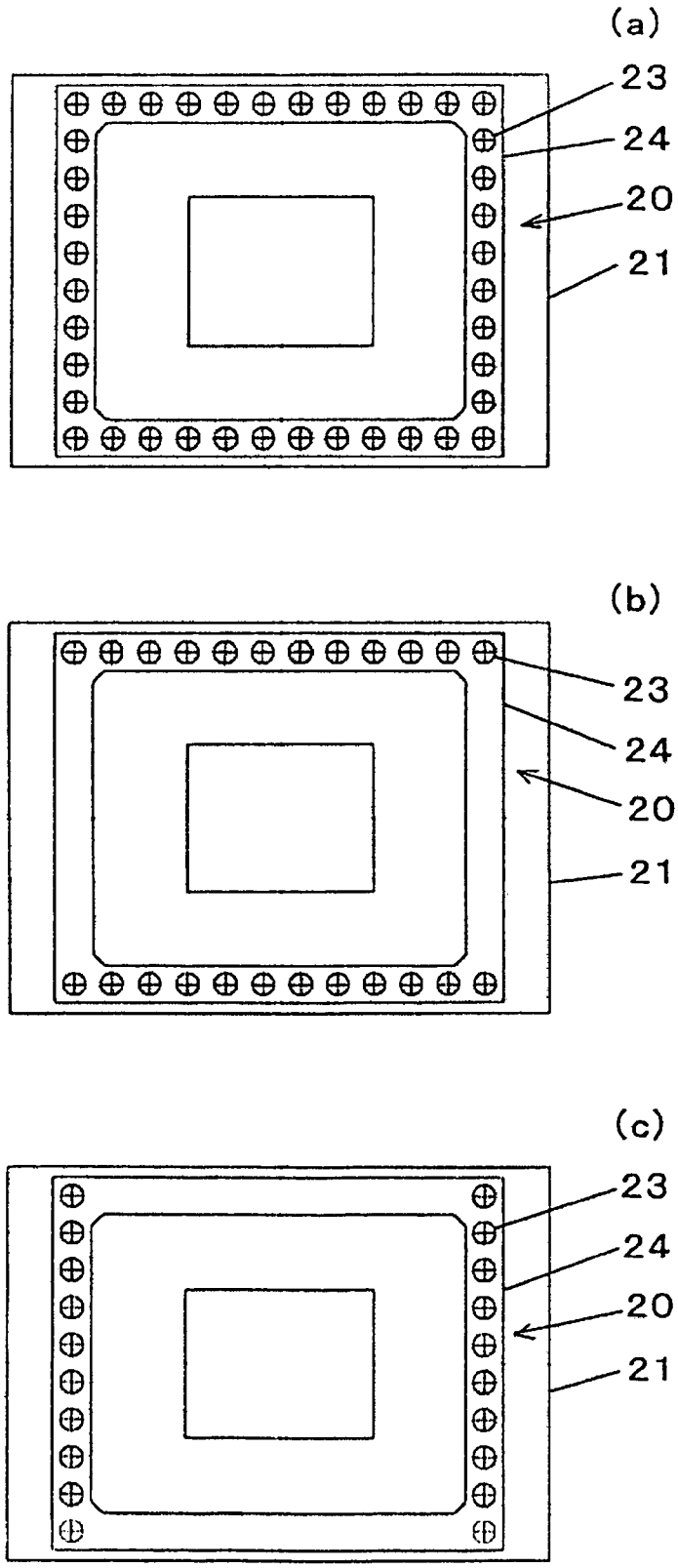
FIG. 7(*a*) shows a plain view indicating an embodiment of an arrangement of compression coil springs 23,23.

Below, an embodiment using another expanding and contracting means is explained based on FIGS. 5-7. The expanding and contracting means 20 is disposed at the peripheral border of the pattern portion of the match plate 21 as shown in FIGS. 5-7, wherein the expanding and contracting means 20 can be expanded and contracted by being pressed with the end surfaces of an upper and a lower flask 1, 2, which surfaces oppose the match plate 21. As shown in FIG. 6, the expanding and contracting means 20 is comprised of a plurality of compression coil-springs 23, 23 disposed in a plurality of through-holes 22, 22 formed at the match plate 21, and support members 24, 24 having a frame-like structure and a U-like configuration at its cross section to. hold the plurality of the compression coil-springs 23, 23 by compressing them at both sides of the coil-springs 23, 23. As shown in FIG. 7, it is possible to dispose a plurality of the compression coil-springs 23, 23 of the expanding and contracting means 20 with the following arrangements: arranging them at the entire circumference of the peripheral border of the pattern portion at even intervals as shown in FIG. 7(*a*), arranging them at two longitudinal sides of the peripheral border of the pattern portion at even intervals as shown in FIG. 7(*b*) and arranging them at two lateral sides of the peripheral border of the pattern portion at even intervals as shown in FIG. 7(*c*). In all arrangements of the compression coil-springs explained above based on FIGS. 7(*a*), (*b*), and (*c*), the total force of the coil-springs should be more than the force that can support the weight of the upper and the lower flask 1, 2.

Below, the method for molding molds by using the apparatus of embodiment 2 is explained in detail.

The foundry sand is filled in the upper and the lower molding space defined by a match plate 21, an upper and a lower flask 1, 2, and an upper and a lower squeeze plate 4, 5 as shown in FIG. 5(*a*). Then, the foundry sand in the upper and the lower molding space is squeezed by causing the upper and the lower squeeze plate 4, 5 to further approach each other as shown in FIG. 5(*b*). Next, the compression coil-springs 23, 23 of the expanding and contracting means 20 of the match plate 21 are compressed by pressing the lower flask 2 toward the match plate 21 until the ends of the support members 24, 24 contact both end surfaces of the match plate 21. When the compression coil-springs 23, 23 are compressed, each of the pattern portions of the match plate 21 moves relatively toward the upper and the lower squeeze plate 4, 5. Consequently, the foundry sand in the upper and the lower molding space is further squeezed.

Embodiment 3

Figure 8:
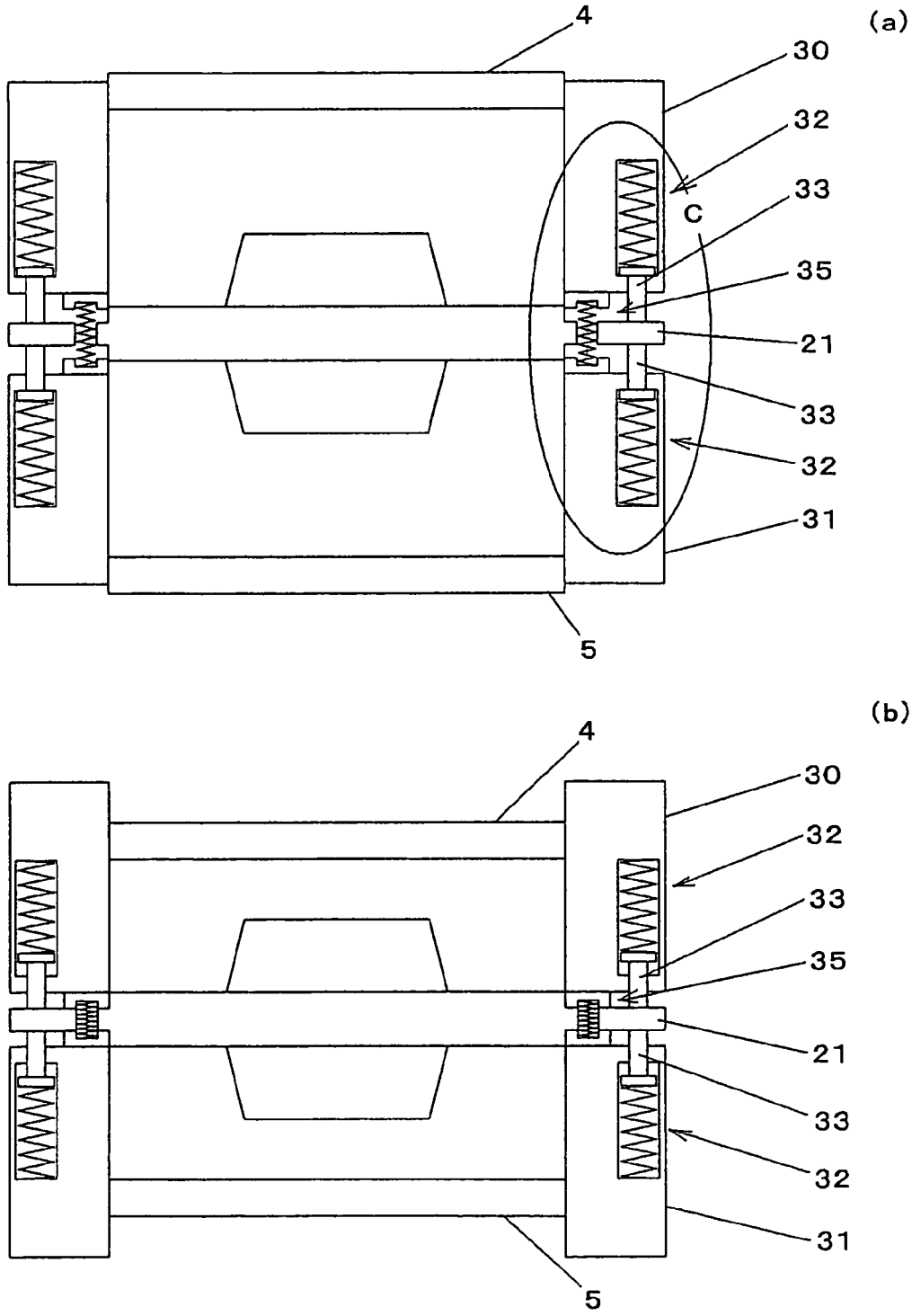
FIG. 8(*a*) shows a cross section of an elevational view indicating a state before squeezing foundry sand in an embodiment of this invention.
Figure 9:
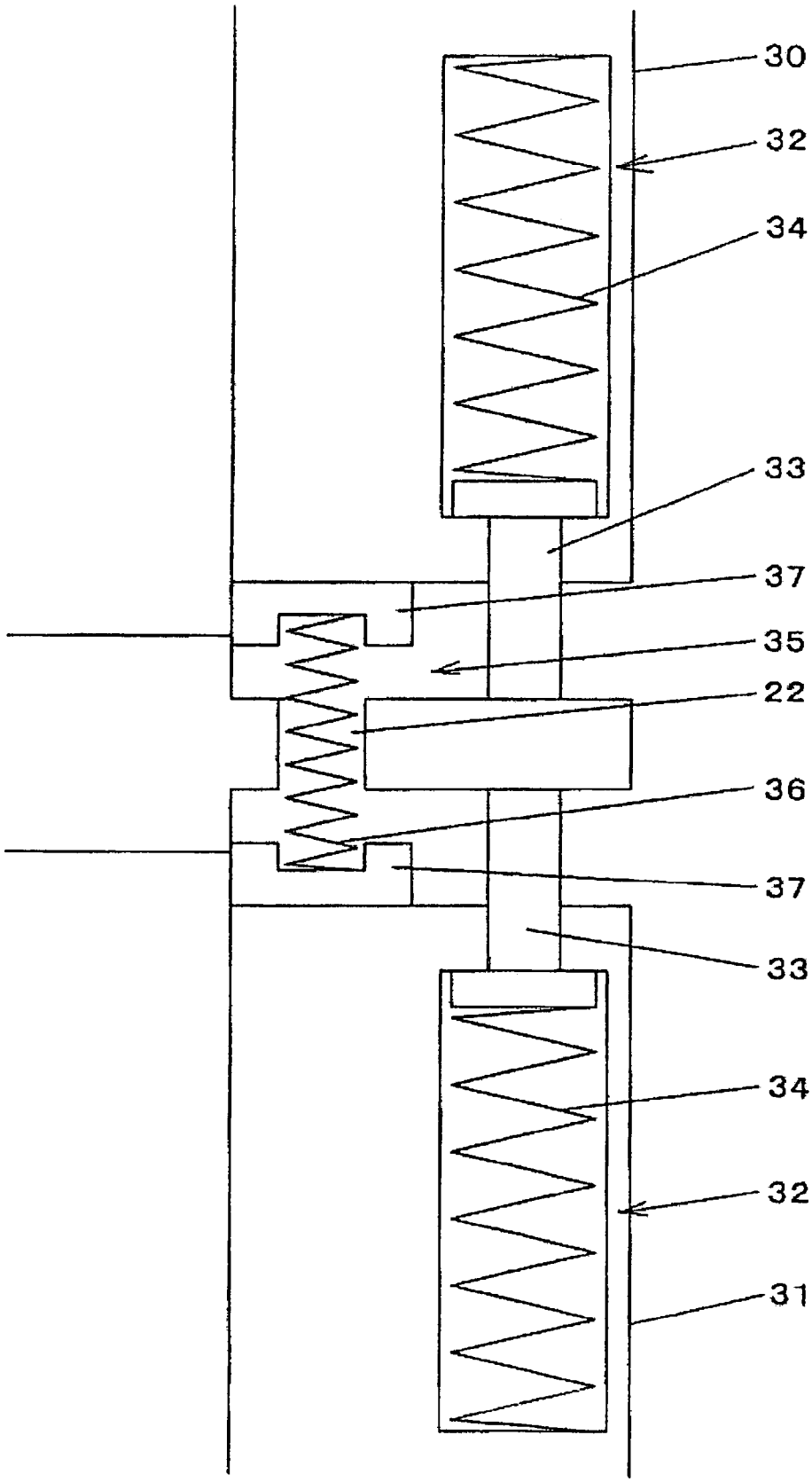
FIG. 9 shows an enlarged view of a part "C" of FIG. 8(*a*).
Figure 10:
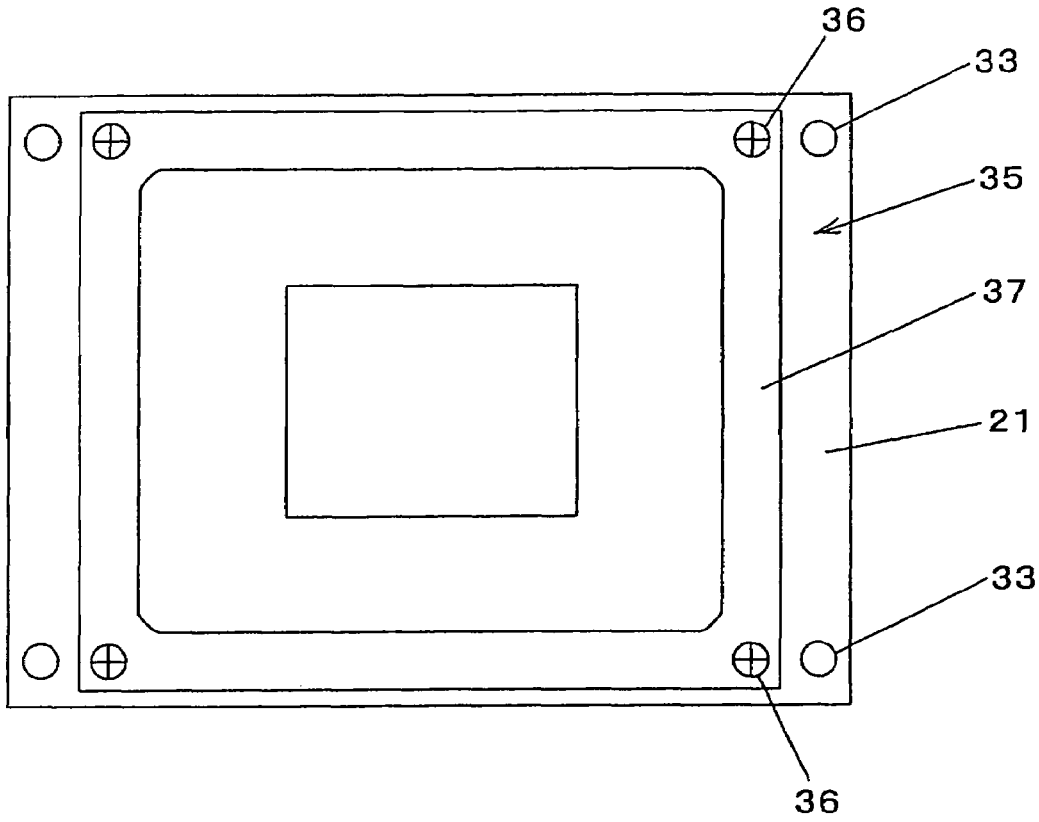
FIG. 10 shows a plain view indicating an embodiment of an arrangement of pins 33, 33 and the compression coil springs 23, 23.

Below, an embodiment using another expanding and contracting means is explained based on FIGS. 8-10. The first expanding and contracting means 32 is disposed at the end surfaces of the upper and the lower flask 30, 31, which surfaces oppose the match plate 21, as shown in FIGS. 8-10, wherein the first expanding and contracting means 32 can be expanded and contracted by being pressed with the end surfaces of an upper and a lower flask 30, 31, which surfaces oppose the match plate 21. As shown in FIG. 9, the first expanding and contracting means 32 is comprised of pins 33, 33 that are slidably disposed in the upper and the lower flask 30, 31 and protrude from the flasks, and a plurality of compression coil-springs 34, 34 to apply the force so that the pins 33, 33 are expanded. The end surfaces of the pins 33, 33 extend toward and contact the end surfaces of the match plate 21. The pins 33, 33 disposed at the first expanding and contracting means 32 contact the four corners of the match plate 21 as shown in FIG. 10.

The second expanding and contracting means 35 is disposed at the peripheral border of the pattern portion of the match plate 21 as shown in FIGS. 8-10. The second expanding and contracting means 35 can be expanded and contracted by being pressed with end surfaces of an upper and a lower flask 30, 31, which surfaces oppose the match plate 21. As shown in FIG. 9, the second expanding and contracting means 35 is comprised of a plurality of compression coil-springs 36, 36 disposed in a plurality of through-holes 22, 22 formed at the match plate 21, and support members 37, 37 having a frame-like structure and a U-like configuration at its cross section to hold the plurality of the compression coil-springs 23, 23 by compressing them with both sides of the coil-springs 23, 23. The plurality of the compression coil-springs disposed at the second expanding and contracting means 35 are located at the four corners of the support members 37, 37 as shown in FIG. 10.

Below, the method for molding molds by using the apparatus of embodiment 3 is explained in detail.

The foundry sand is filled in the upper and the lower molding space defined by a match plate 21, an upper and a lower flask 30, 31, and an upper and a lower squeeze plate 4, 5 as shown in FIG. 8(*a*). Then, the foundry sand in the upper and the lower molding space is squeezed by causing the upper and the lower squeeze plate 4, 5 to further approach each other as shown in FIG. 8(*b*). Next, the compression coil-springs 36, 36 of the second expanding and contracting means 35 are compressed by pressing the lower flask 31 toward the match plate 21 until the ends of the support members 37, 37 contact both end surfaces of the match plate 21. The pins 33, 33 of the first expanding and contracting means 32 are pushed into the upper and the lower flask 30, 31. Consequently, the compression coil-springs 34, 34 are compressed. Each of the pattern portions of the match plate 21 move relatively toward the upper and the lower squeeze plate 4, 5 by the reaction force of the compression coil-springs 34, 34 and 36, 36. Consequently, the foundry sand in the upper and the lower molding space is further squeezed.

Since the compression coil-springs of the first expanding and contracting means 32 are disposed in the upper and the lower flask 30, 31, and since the length of the coil-springs can be longer than that of the coil-springs of the second expanding and contracting means 35, it is possible to increase the force of the coil-springs. Thus, it is possible to reduce the number of the coil-springs that are needed to produce the force to support the weight of the upper and the lower flask.

Figure 11:
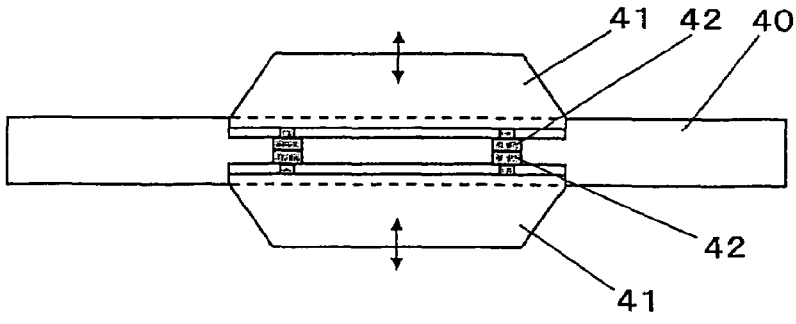
FIG. 11 shows a cross section of an elevational view of another embodiment of this invention.

In the above three embodiments, the foundry sand in the upper and the lower molding space is squeezed by the relative movement between the upper and the lower flask and the pattern portion of the match plate. However, the method for squeezing the foundry sand is not restricted to these embodiments. It is also possible to squeeze the foundry sand in the upper and the lower molding space by individually moving the pattern portions 41, 41 of the match plate 40 by any of the actuators 42, 42 as shown in FIG. 11.

Further, in the above three embodiments, while squeezing the foundry sand in the upper and the lower molding space by causing the upper and the lower squeeze plates 4, 5 to further approach each other, it is possible to effectively and further increase the hardness and strength of the molds near the inner surfaces of the upper and the lower flask by keeping the distance constant between the upper and the lower flask.

In the above three embodiments, the methods use compression coil-springs as the expanding and contracting means. However, the expanding and contracting means is not restricted to the compression coil-springs. It is also possible to use hydraulic cylinders or gas springs as the expanding and contracting means.

This invention can be widely applied to a molding machine having a match plate, such as a molding machine producing a mold having a flask or having no flask. Further, while the foundry sand is filled or squeezed, it is possible to freely determine the position of the upper and the lower flask. For example, the upper and the lower flask can be arranged horizontally or vertically. Further, it is possible to cause the relative position of the upper and the lower flask at the time when the foundry sand is filled to differ from that when it is squeezed.

What we claim is:

1. A method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, and a second squeezing step to squeeze the foundry sand in the upper and the lower molding space by causing pattern portions of the match plate to move to each of the upper and the lower squeeze plate.

2. A method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, and a second squeezing step to squeeze the foundry sand in the upper and the lower molding space by causing pattern portions of the match plate and the plate of the pattern portions to move to each of the upper and the lower squeeze plate by means of causing the upper and the lower flask to further approach each other.

3. A method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, while maintaining a constant distance between the upper and the lower flask, and a second squeezing step to squeeze the foundry sand in the upper and the lower molding space by causing pattern portions of the match plate and the plate of the pattern portions to move to each of the upper and the lower squeeze plate by means of causing the upper and the lower flask to further approach each other.

4. A match plate in a molding assembly for squeezing foundry sand filled in an upper and a lower molding space defined by the match plate, an upper and a lower flask, and an upper and a lower squeeze plate, comprising:

a pattern portion disposed at both sides of the match plate, wherein both sides contact end surfaces of the upper and the lower flask, and an expanding and contracting means disposed at the peripheral border of the pattern portion, wherein the expanding and contracting means can be expanded and contracted by being pressed by the end surfaces of the upper and the lower flask opposing the match plate.

5. A match plate in a molding assembly for squeezing foundry sand filled in an upper and a lower molding space defined by the match plate, an upper and a lower flask, and an upper and a lower squeeze plate, comprising:

a pattern portion disposed at both sides of the match plate, wherein both sides contact end surfaces of the upper and the lower flask, and at least one actuator to cause the pattern portion to individually move from the plate of the pattern portion, or at least one actuator to cause the plate of the pattern portion to individually move from pattern portion.

6. A match plate in a molding assembly for squeezing foundry sand filled in an upper and a lower molding space defined by the match plate, an upper and a lower flask, and an upper and a lower squeeze plate, comprising:

a pattern portion disposed at both sides of the match plate, wherein both sides contact end surfaces of the upper and the lower flask, and at least one actuator to cause the plate of the pattern portion to move toward the upper and the lower squeeze plate.

7. A method for squeezing foundry sand, comprising:

a filling step to fill an upper and a lower molding space defined by the match plate of any one of claims 4, 5, and 6, an upper and a lower flask, and an upper and a lower squeeze plate with the foundry sand, a first squeezing step to squeeze the foundry sand in the upper and lower molding space by causing the upper and the lower squeeze plate to further approach each other, and a second squeezing step to squeeze the foundry sand in the upper and the lower molding space by causing the pattern and/or the plate of the pattern portions of the match plate to move to the upper and the lower squeeze plate.

8. An upper and a lower flask in a molding assembly for squeezing foundry sand filled in an upper and a lower molding space defined by a match plate, the upper and the lower flask, and an upper and a lower squeeze plate, comprising:

a plurality of pins contacting both sides of the match plate, and an expanding and contracting means to expand and contract the pins by pressing them between the upper and the lower flask and both sides of the match plate.

9. A method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, and a second squeezing step to squeeze the foundry sand in the upper and the lower molding space by causing pattern portions of the match plate and the plate of the pattern portions to move to the upper and the lower squeeze plate by means of causing the upper and the lower flask to further approach each other, wherein the upper and the lower flask are comprised of:

a plurality of pins contacting both sides of the match plate, and an expanding and contracting means to expand and contract the pins by pressing them between the upper and the lower flask and both sides of the match plate.

10. A method for squeezing foundry sand filled in an upper and a lower molding space defined by a match plate, an upper and a lower flask, and an upper and a lower squeeze plate, comprising:

a first squeezing step to squeeze the foundry sand in the upper and the lower molding space by causing the upper and the lower squeeze plate to further approach each other, and a second squeezing step to squeeze the foundry sand in the upper and the lower molding space by causing pattern portions of the match plate and the plate of the pattern portions to move to each of the upper and the lower squeeze plate by means of causing the upper and the lower flask to further approach each other, wherein the upper and the lower flask is comprised of:

a plurality of pins contacting both sides of the match plate, and an expanding and contracting means to expand and contract the pins by pressing them between the upper and the lower flask and both sides of the match plate, and wherein the match plate is the match plate of any one of claims 4, 5, and 6.

* * * * *